US009257218B2

(12) United States Patent
Gibbs et al.

(10) Patent No.: US 9,257,218 B2
(45) Date of Patent: Feb. 9, 2016

(54) USING MAGNETS TO POSITION CABLES/FLEXES DURING SYSTEM ASSEMBLY

(71) Applicants: Kevin D. Gibbs, Menlo Park, CA (US); Derek W. Wright, Menlo Park, CA (US); John Raff, San Francisco, CA (US)

(72) Inventors: Kevin D. Gibbs, Menlo Park, CA (US); Derek W. Wright, Menlo Park, CA (US); John Raff, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 673 days.

(21) Appl. No.: 13/631,751

(22) Filed: Sep. 28, 2012

(65) Prior Publication Data

US 2014/0091888 A1 Apr. 3, 2014

(51) Int. Cl.
*H01F 7/02* (2006.01)
*B25B 11/00* (2006.01)

(52) U.S. Cl.
CPC ..... *H01F 7/0252* (2013.01); *B25B 11/002* (2013.01); *Y10T 29/49002* (2015.01); *Y10T 29/5313* (2015.01)

(58) Field of Classification Search
CPC ..... B23Q 3/15; B23Q 3/154; B23Q 3/1543; B23Q 3/1546; B25B 11/00; B25B 11/002; B66C 1/04; B66C 1/06; H01F 7/0252; H01R 11/30; Y10T 29/5313; Y10T 29/4902
See application file for complete search history.

(56) References Cited

U.S. PATENT DOCUMENTS 2,721,717 A * 10/1955 Wales ..... 248/52
3,204,154 A * 8/1965 Crandell ..... 335/289
3,229,030 A * 1/1966 Baermann ..... 174/117 F
3,514,731 A * 5/1970 Drake ..... 335/285
3,668,321 A * 6/1972 Lang ..... 381/124
4,825,185 A * 4/1989 Matsui ..... 336/92
6,003,230 A 12/1999 Trumper et al.
6,468,624 B1 10/2002 Fujisawa et al.
6,477,749 B1 * 11/2002 Reiter ..... 24/303
6,793,184 B2 * 9/2004 Dougal et al. ..... 248/206.5
6,803,738 B2 10/2004 Erten
7,024,792 B2 * 4/2006 Graham ..... 33/770
7,059,743 B2 6/2006 Niemann
7,699,277 B2 * 4/2010 Bagnall ..... 248/206.5
8,161,909 B2 * 4/2012 Sprung ..... 119/264
8,187,006 B2 5/2012 Rudisill et al.
8,403,278 B1 * 3/2013 Kasbohm ..... 248/206.5
8,479,685 B2 * 7/2013 Sprung ..... 119/51.04
8,704,623 B2 * 4/2014 Dumonski ..... 335/285
8,739,453 B1 * 6/2014 Conner ..... 42/99
2002/0065115 A1 * 5/2002 Lindholm ..... 455/568
2004/0206857 A1 * 10/2004 Barr ..... 248/74.1

* cited by examiner

*Primary Examiner* — Lee D Wilson
*Assistant Examiner* — Tyrone V Hall, Jr.
(74) *Attorney, Agent, or Firm* — Downey Brand LLP

(57) ABSTRACT

Methods and tools for positioning cables using magnets during assembly of a consumer electronic product are described. Methods described are well suited in the manufacture of portable electronic devices such as mobile phones, computer tablets and the like. Methods involve attaching magnetic components to cables and to one or more surfaces within the enclosure of the electronic devices. During assembly, the magnetic components on the cables magnetically couple with corresponding magnetic components on the surfaces within the enclosure. In this way, the cables can be secured in certain positions and out of the way during the assembly of the electronic device. In some instances, the cables can remain magnetically secured after assembly and during the operation of the electronic device. In other instances, the magnetic components are decoupled after assembly thereby releasing the cables from their secured positions during operation of the electronic device.

21 Claims, 13 Drawing Sheets

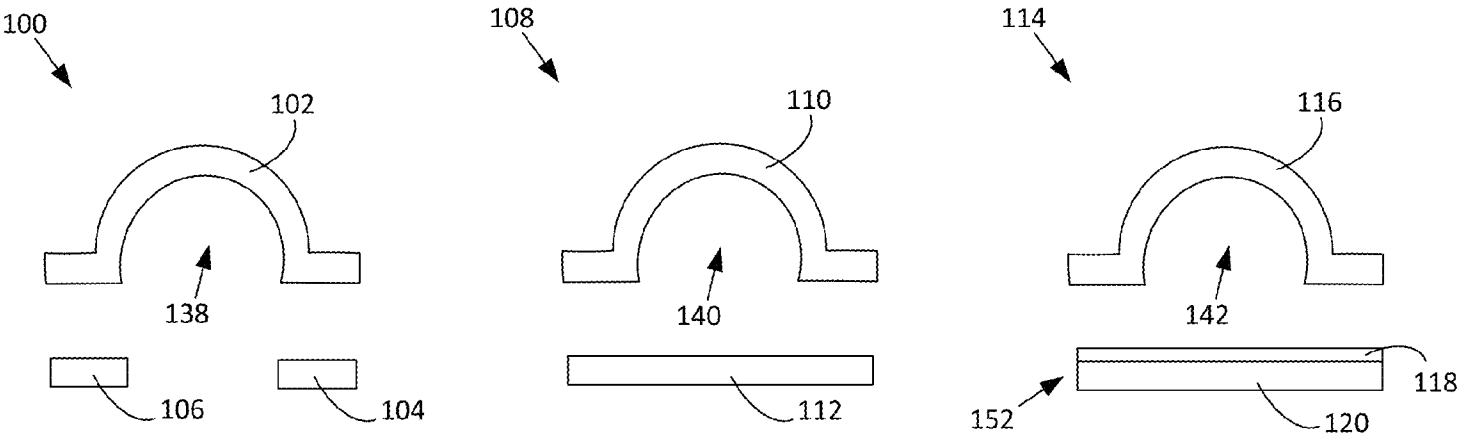
FIG. 10A
FIG. 10B
FIG. 10C
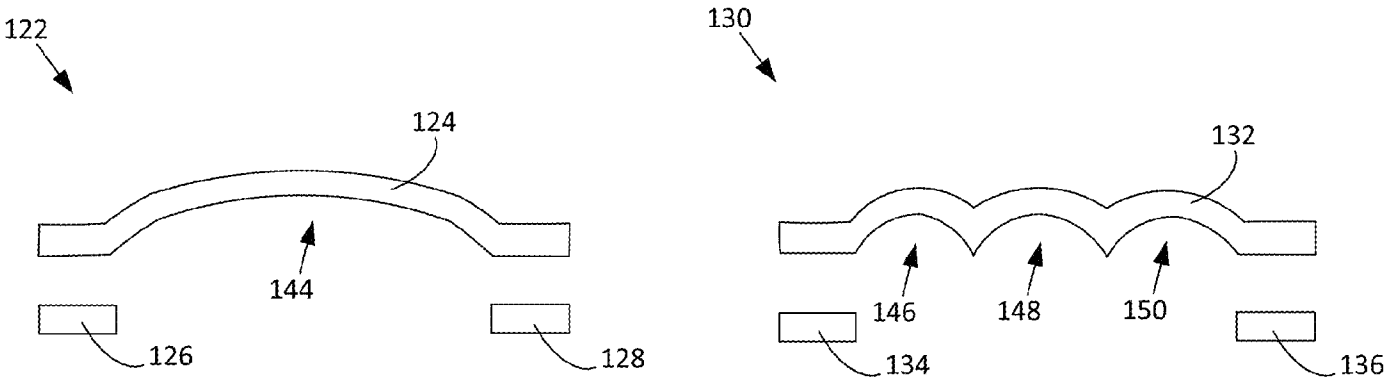
FIG. 10D
FIG. 10E

USING MAGNETS TO POSITION CABLES/FLEXES DURING SYSTEM ASSEMBLY

FIELD OF THE DESCRIBED EMBODIMENTS

The described embodiments relate generally to the assembly of electronic devices. More specifically, embodiments describe methods and tools for using one or more magnets to position cables during assembly of the electronic devices.

BACKGROUND

Consumer electronic products generally have multiple wires and cables connecting various components situated within an enclosure. During assembly, the wires and cables can get in the way of positioning the various components within the enclosure, especially during "blind" assembly when a component obstructs the view of other components and wires while they are being assembled.

A current trend in consumer electronics is to provide portable computing devices that are smarter and capable of doing more complex operations. From an assembly viewpoint, this means installing more components within a small enclosure, making it more difficult to maneuver the various components and cables within the enclosures. In addition, some situations require that certain wires and components be separated or not contact each other once the electronic device is assembled.

SUMMARY

This paper describes various embodiments that relate to methods and tools for assembling cables and components within an electronic device such that the cables are positioned using magnets within the enclosure of the electronic device. Methods described are can be used for assembling components in the manufacture of portable electronic devices such as mobile phones, computer tablets and the like.

According to one embodiment described herein, methods for manufacturing an electronic device having an enclosure and a plurality of components include: attaching at least one magnetically attractable element to at least one cable, the at least one cable configured to electrically couple two or more components of the electronic device; attaching at least one magnetically attractable cable holder to a surface within the electronic device, the at least one magnetically attractable cable holder configured to magnetically couple with the at least one magnetically attractable element; and during assembly of the plurality of components, allowing the at least one magnetically attractable element to magnetically couple with the at least one magnetically attractable cable.

According to another embodiment, a method for manufacturing an electronic device having an enclosure and a plurality of components include: attaching at least one magnetically attractable element to at least one cable, the at least one cable configured to electrically couple two or more components of the electronic device; activating at least one magnetically attractable cable holder configured to magnetically couple with the at least one magnetically attractable element; and during assembly of the plurality of components, allowing the at least one magnetically attractable element to magnetically couple with the at least one magnetically attractable cable holder such that the at least one cable is secured to the surface in a predefined configuration.

According to another embodiment, system for cable routing in electronic devices includes: a magnetically attractable element configured to engage with a cable; and a magnetically attractable cable holder configured to magnetically couple with the magnetically attractable element and secure the cable to an interior surface of a device housing.

According to another embodiment, a system for manufacturing an electronic device having an enclosure and a plurality of components includes: an electromagnetic fixture configured to receive and support the electronic device, the electromagnetic fixture comprising at least one electromagnet; and at least one magnetically attractable element configured to engage with at least one cable, the at least one cable configured to electrically couple two or more components of the electronic device, the at least one magnetically attractable element further configured to magnetically couple with the at least one electromagnet.

BRIEF DESCRIPTION OF THE DRAWINGS

The embodiments will be readily understood by the following detailed description in conjunction with the accompanying drawings with like reference numerals designating like structural elements, and in which:

FIGS. 10A-10E illustrate side views of various embodiments of magnetic cable holder assemblies in accordance with described embodiments.

DETAILED DESCRIPTION OF SELECTED EMBODIMENTS

Figure 1C:
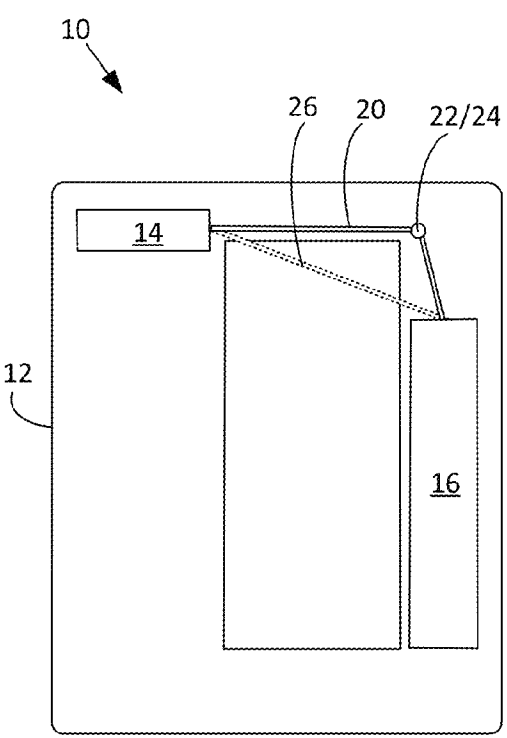
FIGS. 1A-1C illustrate top views of an electronic device during an assembly process using a magnetic cable holder assembly in accordance with described embodiments.

The following disclosure describes various embodiments of electronic devices, such as portable electronic devices including, for example, mobile telephones. Certain details are set forth in the following description and Figures to provide a thorough understanding of various embodiments of the present technology. Moreover, various features, structures, and/or characteristics of the present technology can be combined in other suitable structures and environments. In other instances, well-known structures, materials, operations, and/or systems are not shown or described in detail in the following disclosure to avoid unnecessarily obscuring the description of the various embodiments of the technology. Those of ordinary skill in the art will recognize, however, that the present technology can be practiced without one or more of the details set forth herein, or with other structures, methods and components.

Representative applications of methods and apparatuses according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting, such that other embodiments may be used, and changes may be made without departing from the spirit and scope of the described embodiments.

The following describes methods and tools used for assembling cables and electronic components within an enclosure of an electronic device. During a typical assembly process, some of components of an electronic device are assembled first within the enclosure of the device. Then, various cables are plugged into the assembled components to connect them to other components within the enclosure. Often, this requires the use of a service loop which is an extra length of cable to provide accessibility, freedom of movement and/or neatness during the assembly procedure. If the enclosure of the device is small and the number of components is large, however, the extra length of cable may impede the assembly process or take up valuable space within the housing that could otherwise be used for components.

In addition, in a conventional assembly process, once the device is fully assembled the cables are usually allowed to lie at any location and in any configuration within the enclosure, including on top of or beneath other components of the device. This can become an issue if the configuration of the cables affects the performance of the device. For instance, many electronic devices can include antennas for providing Wi-Fi, 3G, Long Term Evolution (LTE), and/or Bluetooth capability. In some cases, the performance of antennas can depend on the accurate configuration and placement of the antenna cables. The antennas can be tuned for best performance given a certain cable configuration. However, if the positions of the antenna cables are inconsistently configured within the enclosures from device to device, one device may have a better antenna performance than another device depending upon the antenna cable configuration of each device.

Methods and tools described herein allow for the consistent positioning of cables during assembly of an electronic device using a magnetic cable holder assembly. In addition, the magnetic cable holder assembly described herein can allow the securing of cables so as to allow better access to different components during the assembly process. Since the cables can be positioned out of the way during assembly, in some cases a shorter service loop can be used. Various embodiments of magnetic cable holder assemblies will now be described.

Figure 1B:
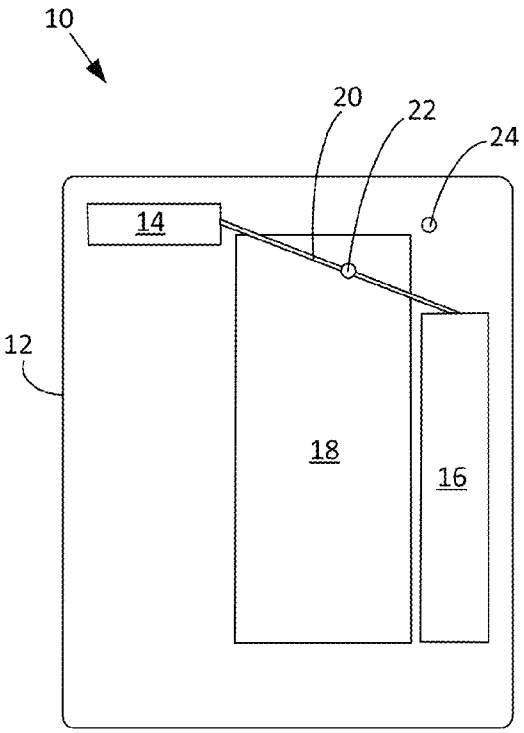
Figure 1A:
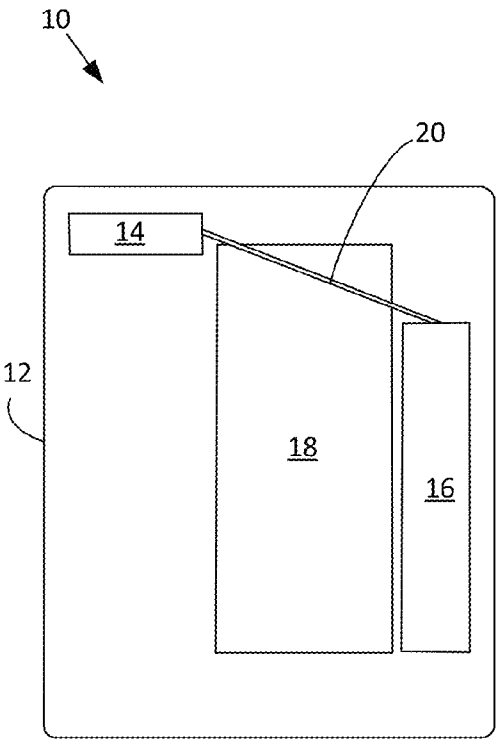

FIGS. 1A-1C illustrate top down views of an electronic device 10 using a magnetic cable holder assembly during an assembly process in accordance with described embodiments. FIG. 1A shows device 10 having an antenna 14, a transmitter/receiver (transceiver) 16, a battery 18, and a cable 20 which connects antenna 14 and transceiver 16, all assembled within housing 12. As shown, cable 20 is positioned on top of battery 18 and therefore impedes the assembly of additional components or housing cover that may be placed on top of battery 18. In addition, since cable 20 is not tethered, the configuration of cable 20 can vary from device to device, thereby affecting the performance of antenna 14 differently in each device. At FIG. 2B, device 10 is fitted with a magnetic cable holder assembly in accordance with described embodiments. The magnetic cable holder assembly includes element 22, which is attached to cable 20, and cable holder 24, which is attached to housing 12. Element 22 and cable holder 24 are made of magnetically attractable material such that they can magnetically couple with each other. For example, element 22 can be made of a permanent magnetic material, such as ferrous or rare earth magnetic material, and cable holder 24 can be made of a non-magnetic material but magnetically attractable material, such as a magnetically attractable metal (e.g., iron, steel, etc.). In alternative embodiments, cable holder 24 is made of a permanent magnetic material and element 22 is made of a non-magnetic material but magnetically attractable material. Element 22 can be attached to cable 20 using any suitable method, including for example, use of an adhesive, crimping or soldering. Cable holder 24 can be attached to the surface of housing 12 using any suitable method, including for example, soldering, welding, or fastening using one or more screws. At FIG. 1C, element 22 is allowed to magnetically couple to cable holder 24 such that cable 20 is secured to an interior surface of housing 12. As shown, cable 20 is no longer positioned on top of battery 18, thus facilitating the assembly of an additional component or a housing cover on top of battery 18. In addition, since cable 20 can be secured in the same defined configuration in other similar devices, the performance of antenna 14 can be tuned for optimal performance based on the defined configuration of cable 20. In this way, the performance of antenna 14 in each device will be tuned for optimal performance.

Figure 2:
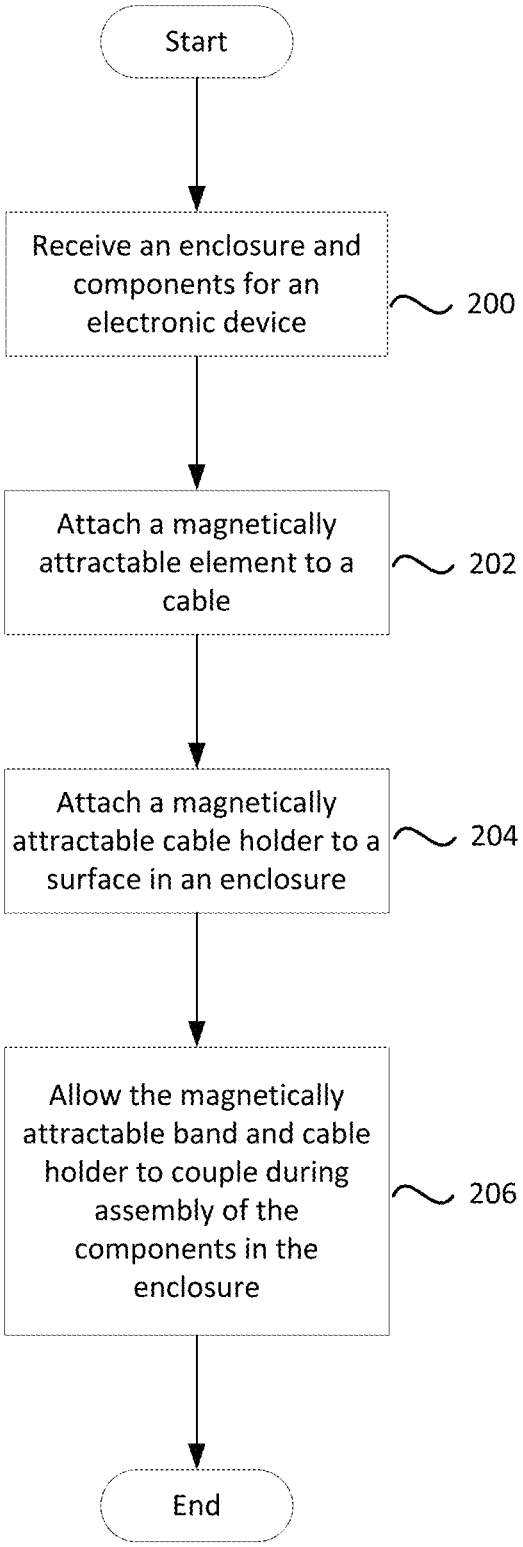
FIG. 2 is a flowchart illustrating steps for assembling an electronic device using a magnetic cable holder assembly in accordance with described embodiments.

As described above, a magnetic cable holder assembly in accordance with described embodiments can be used to secure a cable during an assembly process. FIG. 2 is a flowchart illustrating steps for assembling an electronic device using a magnetic cable holder assembly in accordance with described embodiments. At 200, an enclosure and components for an electronic device is received for assembly. The components can include, for example, a battery, an antenna, integrated circuits, printed circuit boards (PCBs), a flex circuit, a camera, and the like. In some embodiments the enclosure has an electrically conductive portion that allows for grounding of certain components. At 202, a magnetically attractable element is attached to a cable used to electrically couple two or more components of the electronic device. The cable can be any type of cable used for electronic communication of two or more components of the electronic device, including a coaxial cable, a wire, a flex circuit cable or multiple wires/cables banded together. The magnetically attractable element can have any suitable shape for attaching to a cable, including a flat rectangular member attached to a side of the cable or a cylindrical or toroidal shaped member having an interior cylindrical cavity configured to receive the cable. At 204, a magnetically attractable cable holder is attached to a surface in the enclosure. The surface can be, for example, an internal surface of the housing or a surface of one or more components. The magnetically attractable cable holder can have any suitable shape for accepting the magnetically attractable element. If, for example, the magnetically attractable element is cylindrically shaped, the magnetically attractable cable holder can have a curved surface corresponding to a curved exterior portion of the cylindrically shaped magnetically attractable element.

At 206, the magnetically attractable element is allowed to couple with magnetically attractable cable holder during assembly of the components of the device. As describe above with reference to FIGS. 1A-1C, the magnetically attractable element and the magnetically attractable cable holder are configured to magnetically couple with each other. As such, one or both of the magnetically attractable element and magnetically attractable cable holder can include a permanent magnetic material, such as ferrous or rare earth magnetic material. If one of the magnetically attractable element or magnetically attractable cable holder is not made of a permanent magnetic material, it includes at least a portion that is made of magnetically attractable material such as a ferrous material. After the assembly of the electronic device is complete, in some embodiments the magnetically attractable element is allowed to decouple from the magnetically attractable cable holder such that the two pieces are no longer coupled during the operation of the device. In other embodiments, the magnetically attractable element and magnetically attractable cable holder remain magnetically coupled after the assembly and during the operation of the electronic device.

As described above, a magnetic cable holder assembly in accordance with described embodiments includes a magnetically attractable element and magnetically attractable cable holder. Also as described above, the magnetically attractable element and magnetically attractable cable holder can be any suitable shape. FIGS. 3-7 illustrate embodiments of a magnetically attractable element and a magnetically attractable cable holder having particular shapes that can be used in accordance with described embodiments.

Figure 3A:
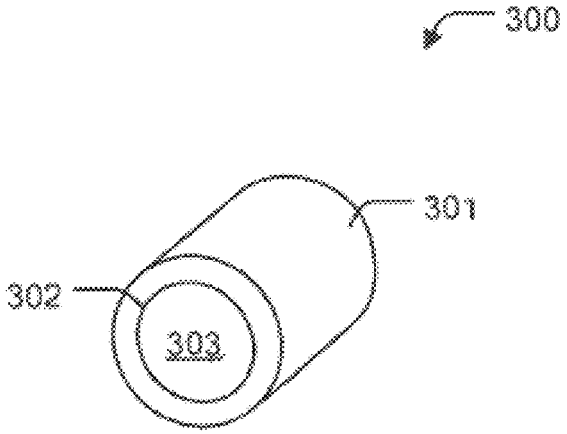
FIGS. 3A and 3B illustrate a perspective view and a side view, respectively, of a magnetically attractable band in accordance with described embodiments.
Figure 3B:
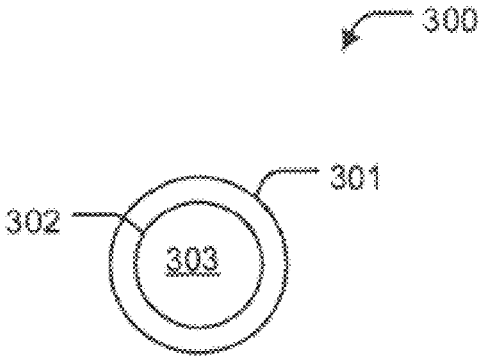

FIGS. 3A and 3B illustrate a perspective view and a side view, respectively, of a magnetically attractable element shaped as a band 300. Band 300 has outer cylindrical wall 301 and inner cylindrical wall 302 which is concentric with outer cylindrical wall 301. Band 300 can also be referred to as a ferrule, hoop or ring. Inner cylindrical wall 302 defines inner cylindrical cavity 303 which is configured to receive a cable.

Figure 4A:
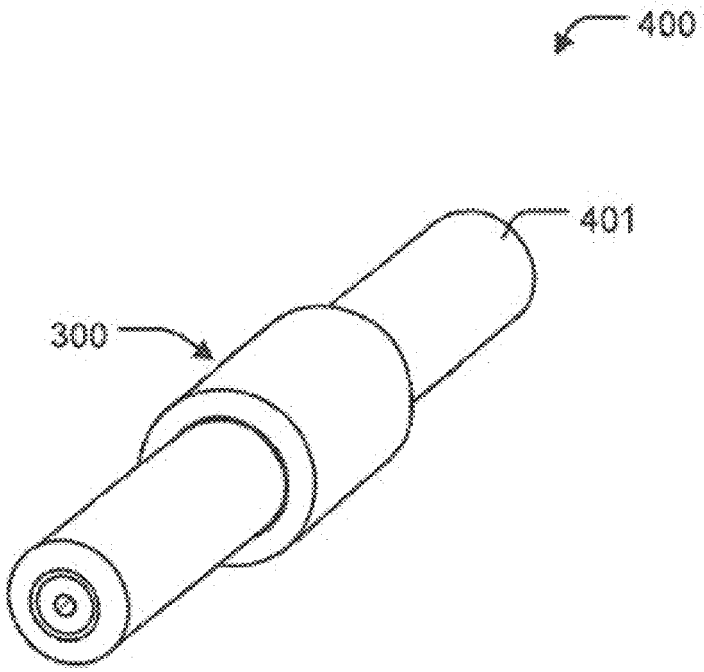
FIGS. 4A and 4B illustrate a perspective view and a cross section view, respectively, of portion of a magnetically attractable band-cable assembly in accordance with described embodiments.
Figure 4B:
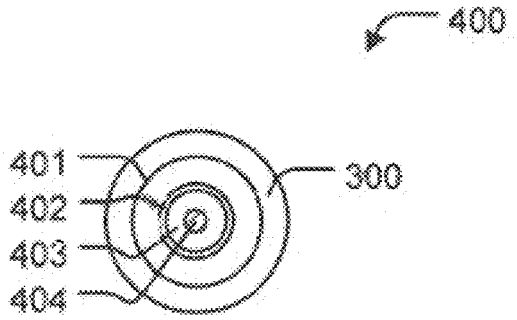

FIGS. 4A and 4B illustrate a perspective view and a cross section view, respectively, of portion of a magnetically attractable band-cable assembly 400. As shown, cable 401 is positioned inside the cylindrical cavity of band 300. Cable 401 is a coaxial cable having jacket 401, shield 402 (typically kept at ground potential), insulator 403 and signal conductor 404. Although particularly described and illustrated as a coaxial cable, it should be readily understood that embodiments of the invention are applicable to any suitable cable, including cables with one of more conductors not arranged coaxially, single conductor wires, flexible flat interconnect cables, or any other suitable cable.

Figure 5A:
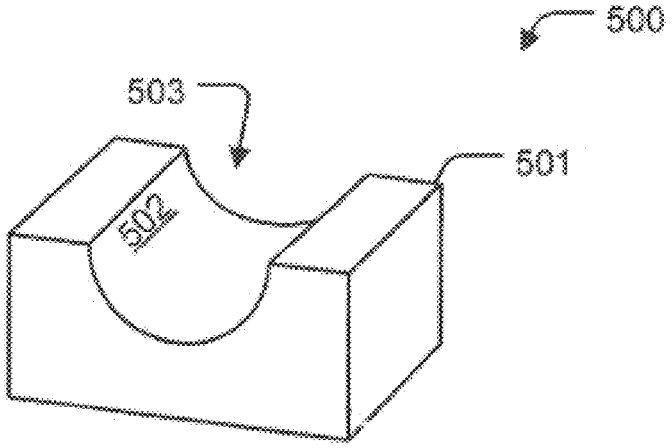
FIGS. 5A and 5B illustrate a perspective view and a side view, respectively, of a magnetically attractable cable holder in accordance with described embodiments.
Figure 5B:
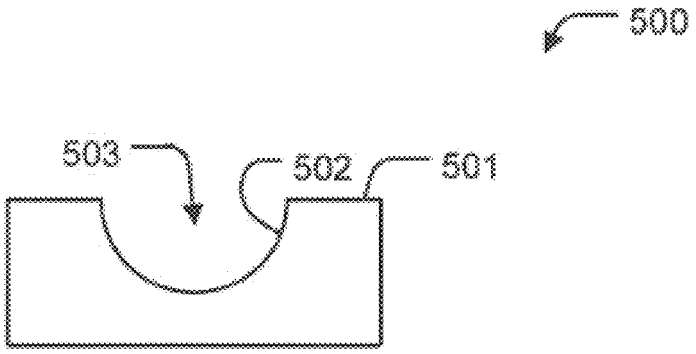

FIGS. 5A and 5B illustrate a perspective view and a side view, respectively, of a magnetically attractable cable holder shaped as a cradle. Cradle 500 has a base 501 with cut out 503 shaped to have a curved surface 502 configured to accept band 300.

Figure 6A:
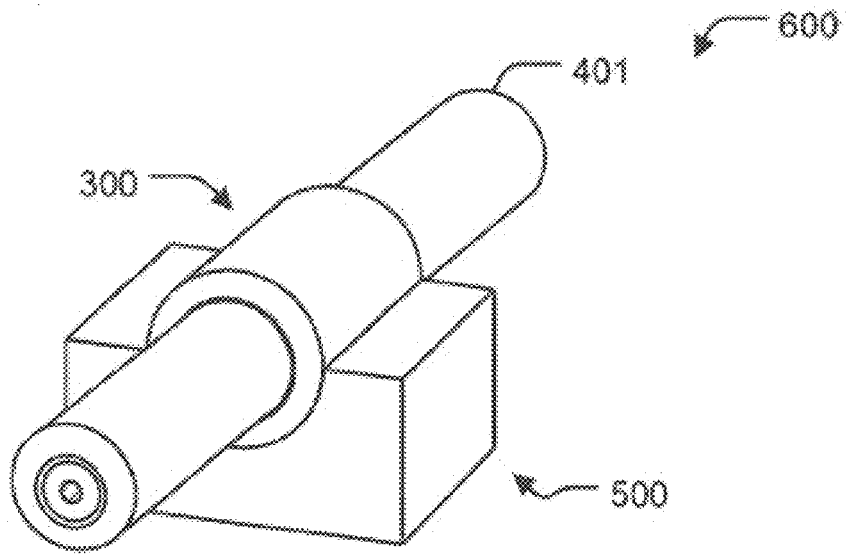
FIGS. 6A and 6B illustrate a perspective view and a cross section view, respectively, of portion of a magnetically attractable band-cable assembly coupled to a magnetically attractable cable holder in accordance with described embodiments.
Figure 6B:
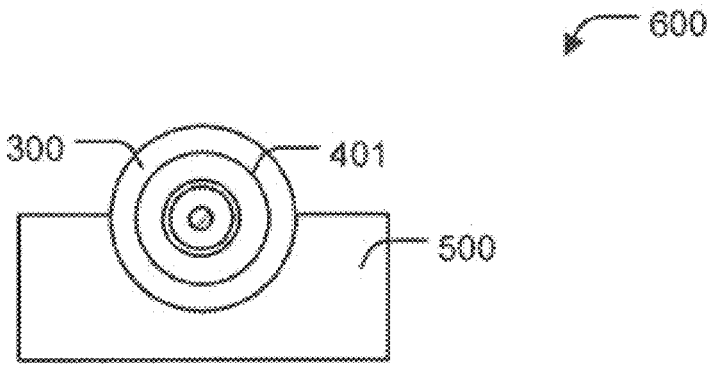

FIGS. 6A and 6B illustrate a perspective view and a cross section view, respectively, of magnetic cable holder assembly 600. Magnetic cable holder assembly 600 has cable 401 positioned in band 300, which is in turn inserted in and magnetically coupled to cradle 500. If magnetic cable holder assembly 600 is assembled in an enclosure during an assembly process, cable 401 can be secured at the surface in which cradle 500 is affixed. As described above, the surface can be on the enclosure or on a component of the device.

FIG. 7A-7E illustrate various views of a magnetically attractable band-cable assembly 700 having grounding capability in accordance with described embodiments. This configuration can be useful for situations when a cable that is being secured also requires grounding.

Figure 7A:
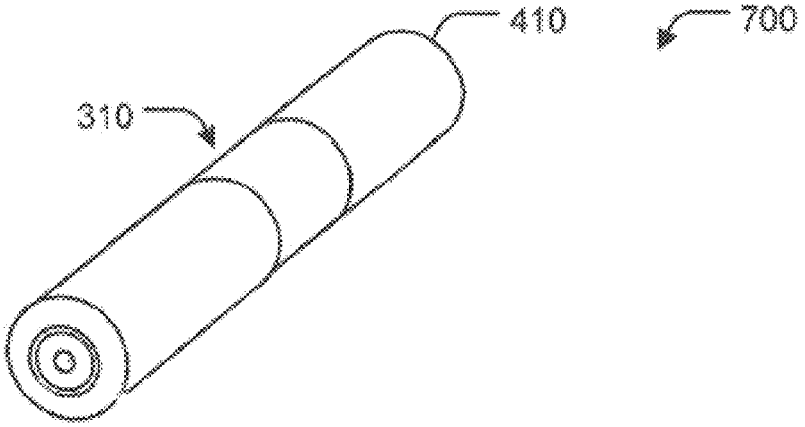
FIG. 7A-7E illustrate various views of a magnetically attractable band-cable assembly having grounding capability in accordance with described embodiments.
Figure 7B:
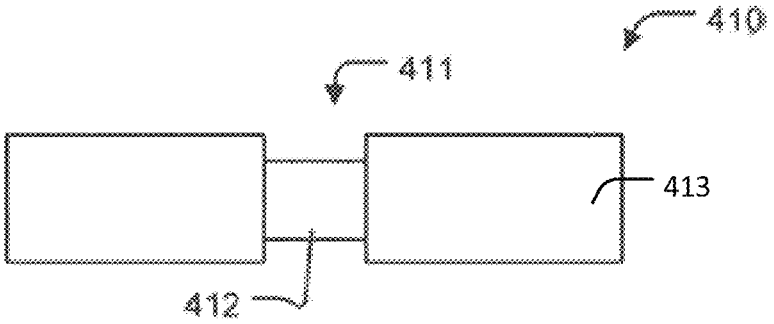
Figure 7C:
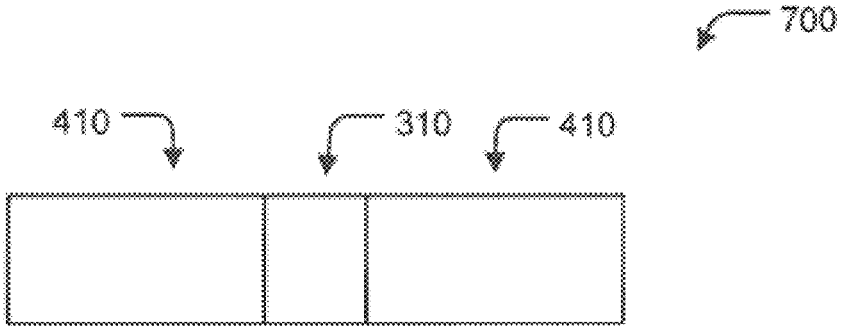

FIGS. 7A-7C show band 310 attached to coax cable 410, where band 310 is electrically coupled to shield 412. In order to couple band 310 to shield 412, a portion 411 of jacket 413 is removed, as shown in FIG. 7B. In a typical configuration, shield 412 is held at ground potential during operation of the electronic device. Thus, when the magnetically attractable band-cable assembly 700 is magnetically coupled to a corresponding cradle which is affixed to a grounded surface such as the enclosure of the electrical device, shield 412 will be grounded to the enclosure.

Figure 7D:
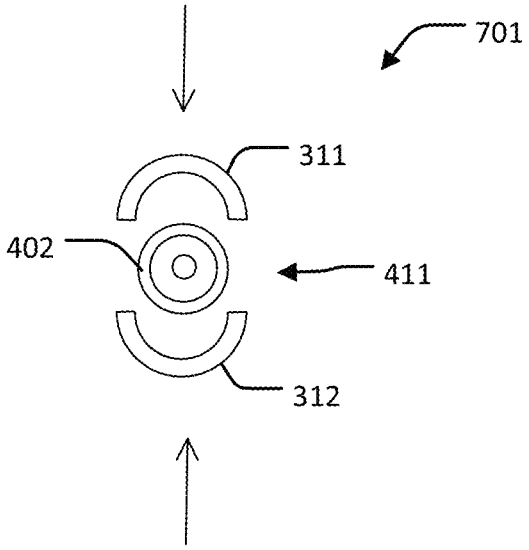
Figure 7E:
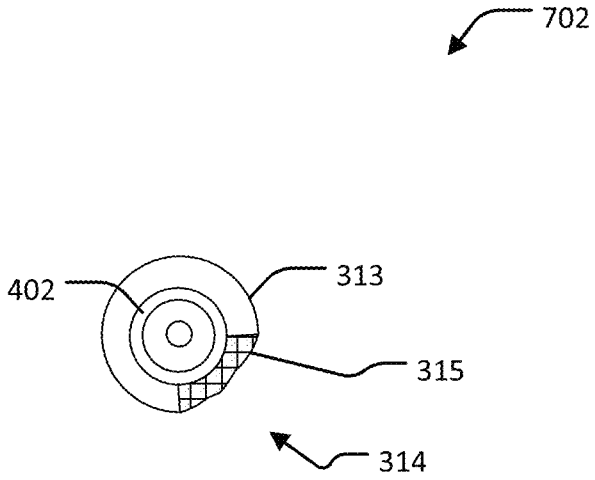

FIGS. 7D and 7E show two separate embodiments for attaching a band to a coaxial cable in a manner in which the band is electrically coupled to a coax shield. Referring to the embodiment of FIG. 7D, magnetically attractable band-cable assembly 701 is formed by coupling a first piece 311 and a second piece 312 of band 310 around a portion of cable 411. After a portion of insulating jacket 413 has been stripped revealing shield 402, first 311 and second 312 pieces of band 310 can be soldered directly to shield 402.

Turning to a different embodiment shown in FIG. 7E, magnetically attractable band-cable assembly 702 is formed by positioning band 313 around a portion of shield 402. Band 313 has a cutout portion 314 that allows band 313 to be positioned around the cable. Solder 315 is used to couple band 313 to shield 402 as well as fill in cutout portion of band 313. Alternatively, conductive adhesive or other suitable adhesive forms may be used to couple the band 313 to shield 402.

As described above, the magnetic cable holder assemblies described herein can have various configurations in order to secure cables inside an enclosure for an electronic device during assembly, and in some cases, after assembly and during the operation of the electronic device.

Figure 8:
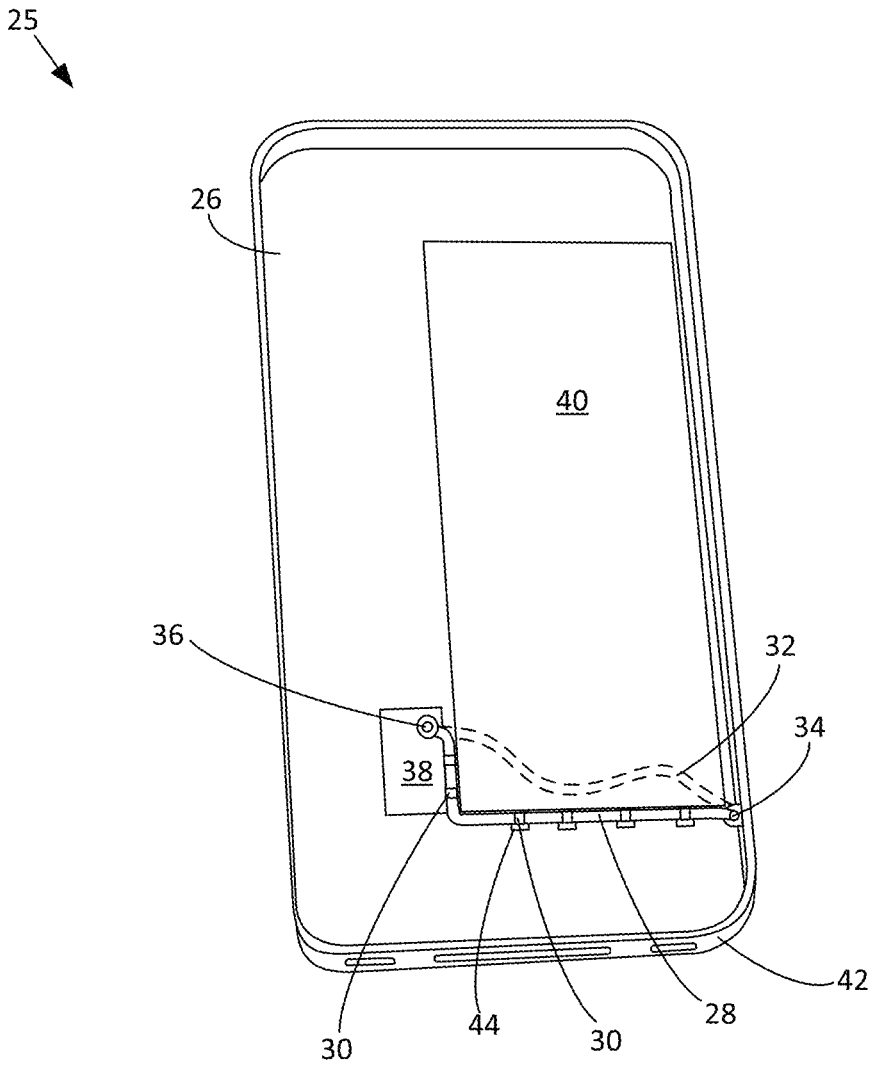
FIG. 8 illustrates a perspective view of an electronic device with a magnetic cable holder assembly in accordance with described embodiments.

FIG. 8 is a perspective view of an electronic device 25 with a magnetic cable holder assembly that secures a cable during the operation of the device. Device 25 has a metal enclosure 26, battery 40 and an electrically conductive band 42 around the perimeter of enclosure 26 that can act as an antenna. Antenna 42 electrically communicates with transceiver 38 at connectors 34 and 36 via coaxial cable 28. As shown, coaxial cable 28 can be secured to housing 26 using bands 30 which are magnetically coupled to cradles 44, which are in turn electrically coupled to metal enclosure 26. Bands 30 are electrically coupled to the shields of coaxial cable 28, such as described in the configuration of FIGS. 7A-7E. In this way, coaxial cable 28 for antenna 42 can provide a ground potential to enclosure 26 at bands 30 and cradles 44. In addition, because cable 28 can be secured in a defined configuration around battery 40 using bands 30 and cradles 44 from device to devices, antenna 42 can be tuned to an optimal performance based on the defined configuration of cable 28. Dotted line 32 shows the conventional placement of cable 28 without the use of bands 30 and cradles 44. Dotted line 32 shows that the cable without the magnetic cable holder assembly would lie under the battery and be allowed to have any configuration from device to device, thereby detrimentally affecting the performance of antenna 42.

Figure 9:
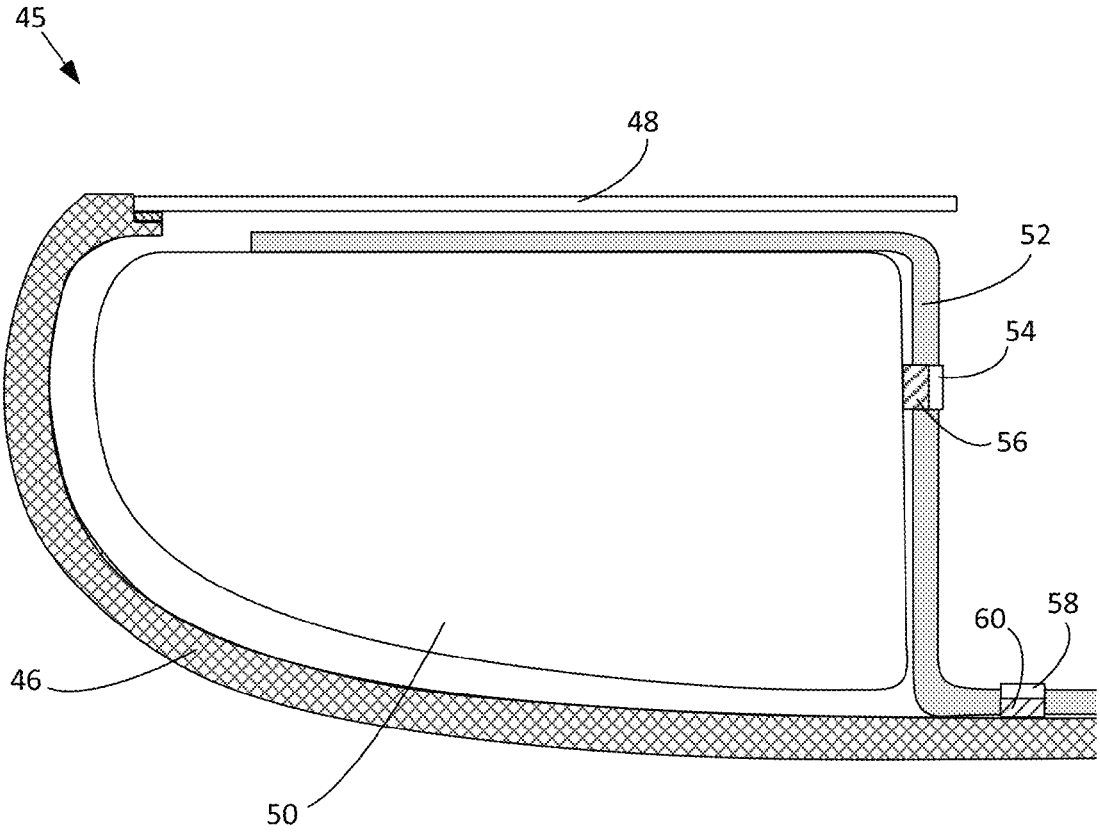
FIG. 9 illustrates a cross section view of a portion of an electronic device having a magnetic cable holder assembly in accordance with described embodiments.

The magnetic cable holder assemblies described herein can also be used to secure cables in non-coplanar surfaces within an electronic device. FIG. 9 is a cross section view of a portion of an electronic device having a magnetic cable holder assembly securing cables at non-coplanar surfaces. Electronic device 45 has a flexible circuit antenna 52 that has a portion positioned on top of carrier 50. Carrier 50 provides a flat surface for positioning flex circuit antenna 52 close to cover glass 48 for optimal performance of flexible circuit antenna 52. Magnetically attractable elements 54 and 58 are attached to flexible circuit antenna 52 and are magnetically coupled to magnetically attractable cable holders 56 and 60, respectively. As shown, magnetically attractable element 54 and cable holder 56 secure flexible circuit antenna 52 to a surface of carrier 50. Magnetically attractable element 58 and cable holder 60 secure flexible circuit antenna 52 to a surface of enclosure 46. Flexible circuit antenna 52 has a defined configuration which can be repeated from device to device. Thus, flexible circuit antenna 52 can be tuned for optimal performance given this defined repeatable configuration.

FIGS. 3-7 described above illustrate a magnetically attractable element and cable holder in the form of corresponding bands and cradles, respectively. It should be noted that the magnetic cable holder assemblies described herein can have any suitable shapes and sizes. For example, FIGS. 10A-10E are side views of various embodiments of magnetic cable holder assemblies in accordance with described embodiments.

FIG. 10A shows magnetic cable holder assembly 100 having a u-shaped magnetically attractable element 102 configured to receive a cable in opening 138. Magnetically attractable holder components 104 and 108 are attached to a surface within the enclosure of an electronic device. U-shaped element 102 is magnetically coupled to parts 104 and 106 with a cable positioned therein, thereby securing the cable during assembly.

FIG. 10B shows magnetic cable holder assembly 108 having a u-shaped magnetically attractable element 110 configured to receive a cable in opening 140. During assembly, u-shaped element 110 is magnetically coupled to magnetically attractable cable holder 112 with a cable secured therein.

FIG. 10C shows magnetic cable holder assembly 114 having a u-shaped magnetically attractable element 116 configured to receive a cable in opening 142. During assembly, u-shaped element 116 is magnetically coupled to magnetically attractable cable holder 152, which includes a magnetically attractable portion 118 and a non-magnetically attractable portion 120.

FIG. 10D shows magnetic cable holder assembly 122 having a wide u-shaped magnetically attractable element 124 configured to receive a wide cable, such as a cable as part of a flexible electronic component, in opening 144. During assembly, wide u-shaped element 124 is magnetically coupled to magnetically attractable cable holder parts 126 and 128 with a cable secured therein. It should be noted that single piece cable holders, such as cable holders 112 and 152, can alternatively be used.

FIG. 10E shows magnetic cable holder assembly 130 having multiple openings 146, 148 and 150 configured to receive multiple cables. During an assembly process, magnetic cable holder assembly 130 is magnetically coupled to magnetically attractive cable holders 134 and 136 to secure multiple cables. It should be noted that single piece cable holders, such as cable holders 112 and 152, can alternatively be used.

As described above, magnetic cable holder assemblies described herein have corresponding magnetically attractable elements and magnetically attractable cable holders that are magnetically coupled at least during an assembly process of an electronic device. In some embodiments, the magnetically attractable elements and magnetically attractable cable holders can each have an array of magnetic components. For example, FIG. 11 illustrates side views of magnetic cable holder assemblies having coded magnetic arrays in accordance with described embodiments.

Figure 11:
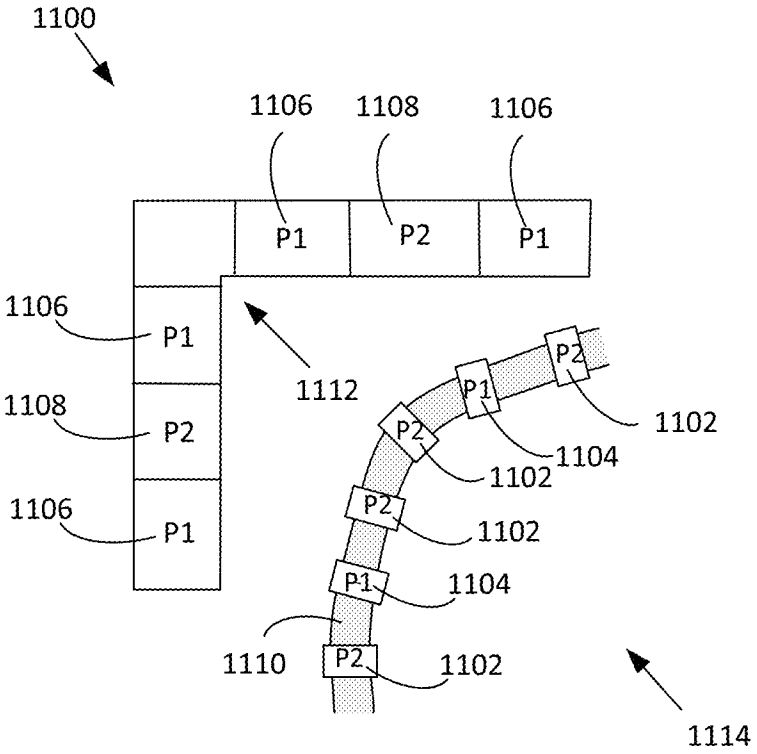
FIG. 11 illustrates a side view of a magnetic cable holder assembly having coded magnetic arrays in accordance with described embodiments.

At FIG. 11, magnetically attractable cable holder 1112 has regions 1108 of a first polarization P1 and regions 1106 of a second polarization P2. Magnetically attractable cable holder 1112 can be attached to a surface within an enclosure of an electronic device. Cable 1114 can be used for electronic communication between two or more components within the electronic device. Cable 1114 has polarized magnetic bands 1102 and 1104 attached thereto. During assembly of the electronic device, polarized magnetic bands 1102 can be attracted to polarized magnetic portions 1106 and polarized magnetic bands 1104 can be attracted to polarized magnetic portions 1108. This configuration can be useful in situations where it is desirable to have longer lengths of cable 1110 secured to a particular location and in a particular configuration, such as in a corner configuration shown in FIG. 11.

Figure 12:
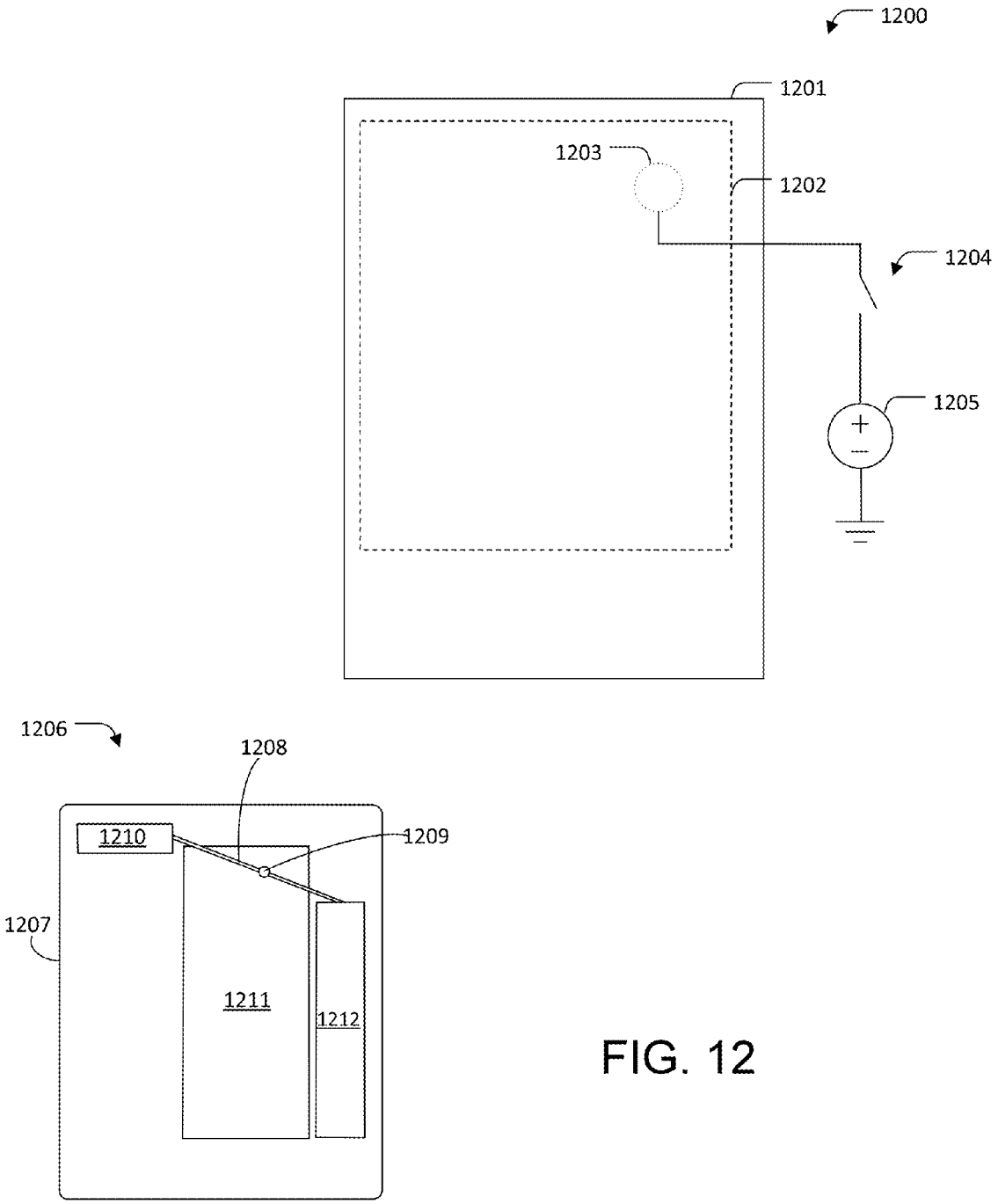
FIG. 12 illustrates an electromagnetic fixture for securing a cable during assembly of an electronic device in accordance with described embodiments.

In some embodiments, an electromagnetic fixture can be used to secure a cable to a particular location in an enclosure during assembly. As an example, FIG. 12 illustrates electromagnetic fixture 1200 having a base 1201 and electromagnet 1203. Dashed line 1202 represents one or more alignment members which can include, for example, corner and side stops, used to position an enclosure 1207 of electronic device 1206 thereon. Electronic device 1206 includes components 1210, 1211 and 1212 with cable 1208 electrically coupling components 1210 and 1212. Magnetically attractable element 1209 is attached to cable 1208. Magnetically attractable element 1209 can be made of permanent magnetic material or a magnetically attractive material such as iron or steel. Power is supplied to electromagnet 1203 by power supply 1205 which is controlled by switch 1204. When switch 1204 is off, no power is supplied to electromagnet 1203 and electromagnet 1203 will not act as a magnet. During an assembly process, electronic device 1206 is positioned on top of base 1201 and enclosure 1207 is physically aligned using alignment members 1202. Switch 1204 is then used to turn on power supply 1205 which activates electromagnet 1203 such that electromagnet 1203 can electromagnetically couple with magnetically attractable element 1209, thereby positioning cable 1208 into a desired position within enclosure 1207. Note that although electromagnet 1203 and magnetically attractable element 1209 do not directly contact each other, they are still magnetically coupled. After the assembly process of electronic device 1206 is complete, switch 1204 is used to turn off power to electromagnet 1203, thereby allowing electromagnet 1203 and magnetically attractable element 1209 to decouple.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method of assembling electronic components within an enclosure of a portable electronic device, the method comprising:

securing a cable to a surface within the enclosure by magnetically coupling a magnetically attractable element to a magnetically attractable cable holder, the magnetically attractable element coupled with the cable and the magnetically attractable cable holder coupled with the surface, the cable configured to electrically couple at least two of the electronic components, wherein the magnetically attractable element and the magnetically attractable cable holder are positioned within the enclosure when the magnetically attractable element and the magnetically attractable cable holder are coupled together.

2. The method of claim 1, wherein the magnetically attractable element remains magnetically coupled with the magnetically attractable cable holder during operation of the electronic device.

3. The method of claim 1, further comprising decoupling the magnetically attractable element from the magnetically attractable cable holder prior to operation of the electronic device.

4. The method of claim 1, wherein the magnetically attractable element comprises:

an outer cylindrical surface; and an inner cylindrical cavity concentric to the outer cylindrical surface, the inner cylindrical cavity configured to engage an outer jacket of the cable.

5. The method of claim 4, wherein the magnetically attractable cable holder comprises:

a curved surface configured to receive and engage the outer cylindrical surface.

6. The method of claim 1, wherein the magnetically attractable element has a toroidal or hoop shape.

7. The method of claim 1, wherein the cable is a coaxial cable configured to couple an antenna with an associated transceiver.

8. The method of claim 1, wherein the cable is part of a flexible circuit assembly.

9. The method of claim 1, wherein the surface is a surface of a component within the enclosure.

10. A method of assembling an internal component within an enclosure of a portable electronic device, the method comprising:

creating a space within the enclosure for the internal component by securing a cable to a surface within the enclosure, the cable configured to electrically couple at least two electronic components of the portable electronic device, wherein the cable is secured by magnetically coupling a magnetically attractable element that is attached to the surface within the enclosure with a magnetically attractable cable holder that is attached to the cable, wherein the magnetically attractable element and the magnetically attractable cable holder are positioned within the enclosure when the magnetically attractable element and the magnetically attractable cable holder are coupled together.

11. The method of claim 10, wherein the magnetically attractable cable holder and/or the magnetically attractable element comprises a permanent magnet.

12. The method of claim 10, wherein the magnetically attractable cable holder and/or the magnetically attractable element comprises an electromagnet.

13. The method of claim 10, wherein the cable is secured to the surface in a predefined configuration.

14. The method of claim 10, wherein one of the magnetically attractable cable holder and the magnetically attractable element is a permanent magnet and the other of magnetically attractable cable holder and the magnetically attractable element is a non-magnetic material.

15. A system for routing a cable in a housing for an electronic device, the system comprising:

a magnetically attractable element coupled with the cable, the magnetically attractable element having an outer cylindrical surface and an inner cylindrical cavity concentric to the outer cylindrical surface, the inner cylindrical cavity configured to engage with an outer jacket of the cable; and a magnetically attractable cable holder configured to magnetically couple with the magnetically attractable element and secure the cable to an interior surface of the housing, wherein the magnetically attractable cable holder includes a curved surface configured to receive the outer cylindrical surface of the magnetically attractable element.

16. The system of claim 15, wherein the magnetically attractable element is configured to provide a ground path for the cable.

17. The system of claim 15, wherein the magnetically attractable element and/or the magnetically attractable cable holder comprises a permanent magnet.

18. A portable electronic device, comprising:

a housing configured to house electronic components; and a system for routing a cable within the housing, the cable configured to electrically couple at least two of the electronic components, the system comprising:

a magnetically attractable element coupled with the cable, and a magnetically attractable cable holder coupled with a surface within the housing, wherein the magnetically attractable cable holder is configured to magnetically couple with the magnetically attractable element and secure the cable to the surface, wherein the magnetically attractable element and the magnetically attractable cable holder are positioned within the housing when the magnetically attractable element and the magnetically attractable cable holder are coupled together.

19. The portable electronic device of claim 18, further comprising:

an internal component, wherein a space within the housing for internal component is created when the magnetically attractable element is magnetically coupled with the magnetically attractable cable holder.

20. The portable electronic device of claim 18, wherein the magnetically attractable element and/or the magnetically attractable cable holder comprises a permanent magnet.

21. The portable electronic device of claim 18, wherein the magnetically attractable cable holder and/or the magnetically attractable element comprises an electromagnet.

* * * * *